US010828654B2

(12) United States Patent
Suzuki

(10) Patent No.: US 10,828,654 B2
(45) Date of Patent: Nov. 10, 2020

(54) FLUID CONTAINER

(71) Applicant: Kotobuki & Co., Ltd., Kawagoe (JP)

(72) Inventor: Tomoaki Suzuki, Kawagoe (JP)

(73) Assignee: KOTOBUKI & CO., LTD., Kawagoe (JP)

( * ) Notice: Subject to any disclaimer, the term of this patent is extended or adjusted under 35 U.S.C. 154(b) by 0 days.

(21) Appl. No.: 16/490,833

(22) PCT Filed: Apr. 27, 2017

(86) PCT No.: PCT/JP2017/016786
§ 371 (c)(1),
(2) Date: Sep. 3, 2019

(87) PCT Pub. No.: WO2018/198277
PCT Pub. Date: Nov. 1, 2018

(65) Prior Publication Data

US 2020/0023392 A1 Jan. 23, 2020

(51) Int. Cl.
*B05B 11/02* (2006.01)
*A45D 34/00* (2006.01)

(52) U.S. Cl.
CPC ..... *B05B 11/025* (2013.01); *A45D 34/00* (2013.01); *A45D 2200/055* (2013.01)

(58) Field of Classification Search
CPC .. B05B 11/025; A45D 34/00; A45D 2200/055
(Continued)

(56) References Cited

U.S. PATENT DOCUMENTS 5,044,523 A * 9/1991 McNab ..... A45D 34/042 222/207
5,277,342 A * 1/1994 Dickau ..... B05B 1/3066 222/387
(Continued)

FOREIGN PATENT DOCUMENTS

JP H07-503899 A 4/1995
JP H09-192581 A 7/1997
(Continued)

OTHER PUBLICATIONS

International Search Report (ISR) (PCT Form PCT/ISA/210), in PCT/JP2017/016786, dated May 30, 2017.

*Primary Examiner* — Paul R Durand
*Assistant Examiner* — Andrew P Bainbridge
(74) *Attorney, Agent, or Firm* — McGinn IP Law Group, PLLC

(57) ABSTRACT

In an embodiment, a fluid container includes a container main body that has a tank housing a fluid; a fluid discharge body disposed on a front end portion of the container main body that discharges the fluid through a discharge port formed in a front end portion thereof; a plunger including an operating body that pushes out the fluid in the tank to the fluid discharge body in a predetermined amount corresponding to an operation of the operating body; and a valve that closes a connecting flow passage connecting the tank to the fluid discharge body and opens the connecting flow passage when the plunger pushes out the fluid, the valve including a valve seat surface, a valve body disposed in front of the valve seat surface to abut the valve seat surface from the front, and a spring biasing the valve body toward the valve seat surface.

5 Claims, 9 Drawing Sheets

1

(58) Field of Classification Search
USPC ..... 222/391, 286
See application file for complete search history.

(56) References Cited

U.S. PATENT DOCUMENTS

| | | | | |
|---|---|---|---|---|
| 9,770,736 | B2 * | 9/2017 | Brugger | A45D 40/262 |
| 9,808,069 | B2 * | 11/2017 | Kim | A45D 34/04 |
| 2002/0117512 | A1 * | 8/2002 | Earle | G03D 3/065 222/82 |
| 2004/0042841 | A1 | 3/2004 | Noguchi | |
| 2007/0086830 | A1 | 4/2007 | Kageyama | |
| 2009/0095777 | A1 * | 4/2009 | Francavilla | B65D 83/0011 222/391 |
| 2010/0121268 | A1 | 5/2010 | Keller | |
| 2019/0116960 | A1 * | 4/2019 | Chen | B05B 11/3032 |
| 2020/0023392 | A1 * | 1/2020 | Suzuki | A45D 34/00 |

FOREIGN PATENT DOCUMENTS

| | | | |
|---|---|---|---|
| JP | 2004-089592 | A | 3/2004 |
| JP | 2007-130437 | A | 5/2007 |
| JP | 2010-531276 | A | 9/2010 |
| JP | 2012-210966 | A | 11/2012 |

* cited by examiner

FLUID CONTAINER

FIELD

This disclosure relates to a fluid container that houses a fluid and has a fluid discharge body on a front end thereof.

BACKGROUND

Patent Documents 1 to 3, for example, describe conventional fluid containers of this type. A liquid container described in Patent Document 1 includes a container main body having a tank portion for housing a liquid, a liquid supply body coupled to a front end side of the container main body, a piston that advances through the tank portion, and a piston push-out mechanism that includes an operating body and feeds the piston forward through the tank portion in response to an operation of the operating body, wherein the liquid supply body is coupled to the container main body detachably, and the piston push-out mechanism is capable of moving the piston only in an advancement direction. According to this liquid container, the liquid supply body can be replaced, and since the liquid does not flow back in the direction of the tank portion, a situation in which liquid that has come into contact with an object to be applied or outside air remains in the liquid container before the liquid supply body is replaced can be prevented from occurring.

A liquid container described in Patent Document 2 includes a main body having a tank portion in which a liquid is housed, a supply mechanism that is coupled to a front end portion of the main body and includes a front end supply body for supplying the liquid, and a drive mechanism for pushing out the liquid in the tank portion to the supply mechanism, wherein a valve that is normally closed and can be opened only when the drive mechanism is activated is provided between the tank portion and the supply mechanism. According to this liquid container, it is possible to provide a liquid container having a liquid leakage suppression function without limiting the viscosity of the liquid stored therein.

In an applicator container described in Patent Document 3, a valve device that closes and opens an introduction path for introducing an application liquid to an applicator and pushing out the application liquid toward the applicator is installed in an applicator container main body. According to this applicator container, the introduction path for introducing the application liquid to the applicator can be closed and opened, and the application liquid can be pushed out toward the applicator.

The following is the reference document.

[Patent Document 1] Japanese Patent Application Publication No. 2007-130437 (see paragraphs [0008] and [0017] and so on, for example);

[Patent Document 2] Japanese Patent Application Publication No. 2004-089592 (see paragraphs [0005] and [0006] and so on, for example); and

[Patent Document 3] Japanese Patent Application Publication No. 1997-192581 (see paragraph [0008] and so on, for example).

DISCLOSURE

In a conventional fluid container having a valve device or a valve, fluid in the container may leak out due to external causes such as transportation even when a fluid discharge path is closed. Therefore, providing a fluid container in which fluid can be prevented from leaking out through a discharge port is desired.

This disclosure has been designed to provide a fluid container in which fluid in the container can be prevented from leaking out through a discharge port during transportation or the like.

SUMMARY

In an aspect of the present invention, a fluid container includes a container main body that has a tank housing a fluid; a fluid discharge body that is disposed on a front end portion of the container main body and discharges the fluid through a discharge port formed in a front end portion thereof; a plunger that includes an operating body and pushes out the fluid in the tank to the fluid discharge body in a predetermined amount corresponding to an operation of the operating body; and an open/close valve that closes a connecting flow passage connecting the tank to the fluid discharge body and opens the connecting flow passage when the plunger pushes out the fluid, the open/close valve including a valve seat surface, a valve body that is disposed in front of the valve seat surface so as to abut the valve seat surface from the front, and a spring that biases the valve body toward the valve seat surface.

In a plurality of aspects of the present invention, a fluid container in which fluid in the container can be prevented from leaking out through a discharge port during transportation can be provided.

DESCRIPTION OF EMBODIMENTS

Figure 1:
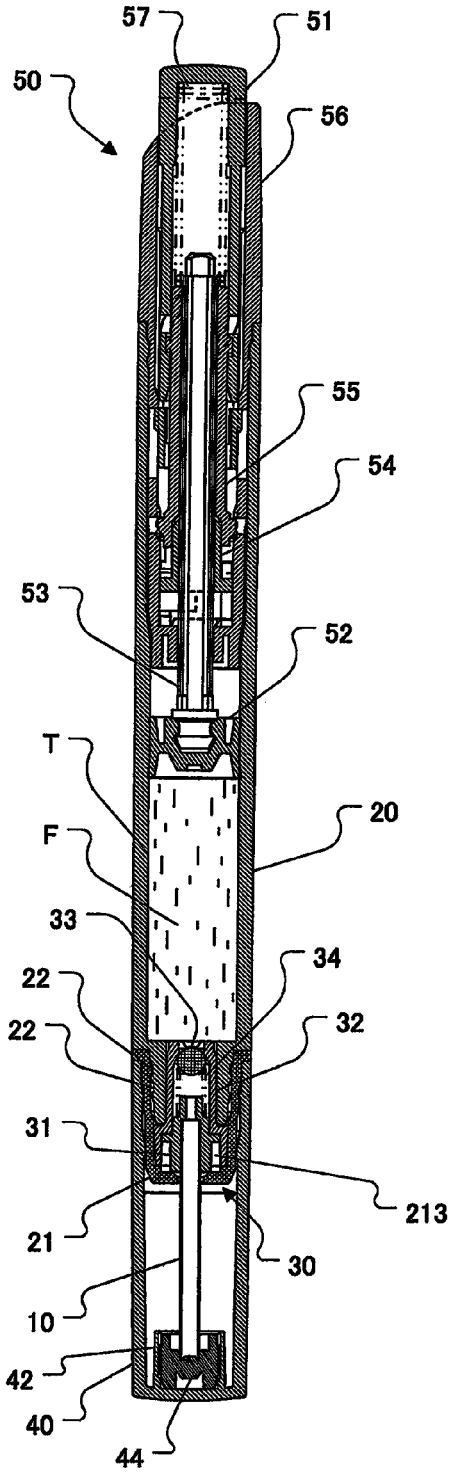
FIG. 1 is a sectional view illustrating a dispenser serving as a fluid container according to an embodiment, taken along a cross-section that includes a central axis thereof.

A plurality of embodiments of the present invention will be described below with reference to the figures. In the descriptions and figures, constituent elements having substantially identical functions have been allocated identical reference numerals, and duplicate description thereof has been omitted.

A dispenser 1 serving as a fluid container according to an embodiment, illustrated in FIG. 1, is formed in a substantially tubular shape, and includes an discharge pipe 10 disposed on a front end portion of a container main body 20 as a fluid discharge body, the container main body 20, which includes a tank T housing a fluid F, a valve 30 disposed between the discharge pipe 10 and the container main body 20 in order to open and close a connecting flow passage through which the fluid F flows, a cap 40 attached to the container main body 20 detachably, a clicking body 51 disposed in a rear end portion of the container main body 20 as an operating body, and a plunger 50 for pushing out the fluid F in the tank T to the discharge pipe 10 in response to an operation of the clicking body 51. The fluid F according to this embodiment is an aromatic substance (a perfumed oil) that is volatilized when discharged onto a heating plate, but in another embodiment, the fluid may be any other desired fluid, for example a fluid, a sol, or a gel for cosmetic purposes, stationery purposes, medical purposes, or oral hygiene purposes. Hereafter, an extending direction of a lengthwise direction central axis of the substantially tubular dispenser 1 will be referred to simply as "the axial direction", the cap 40 side of the dispenser 1, or in other words the lower side of FIG. 1, will be referred to as the front, and the clicking body 51 side, or in other words the upper side of FIG. 1, will be referred to as the rear, so as the cap 40 disposed side end portion will be referred to as the front end portion of the dispenser 1, and the clicking body disposed side end portion will be referred to as the rear end portion of the dispenser 1.

"Discharge Pipe 10"

The discharge pipe 10 is formed in a tubular shape such that a hollow portion thereof forms an discharge flow passage 12 through which the fluid F is discharged. The discharge pipe 10, which in this embodiment is used in proximity to a heat source, is formed from a material exhibiting greater heat resistance than the container main body 20 as well as an discharge pipe support portion 31 and a valve main body 32 included in the valve 30, all of which will be described in detail below. In this embodiment, the discharge pipe 10 is formed from stainless steel. A discharge port 122 of the discharge flow passage 12 is formed in a front end of the discharge pipe 10, and as will be described in detail below, the fluid F is discharged through the discharge port 122 when the plunger 50 pushes out the fluid F frontward.

"Container Main Body 20"

The container main body 20 is formed in a substantially tubular shape, and a front fitting 21, to be described in detail below, is fitted to a front end portion thereof while the plunger 50 is fitted to a rear end portion thereof as a push-out mechanism. The valve 30, to be described in detail below, is disposed in the front fitting 21 assembled to the container main body 20. The tank T housing the fluid F is defined by the valve 30 disposed in the front fitting 21, the container main body 20, and the plunger 50. An inner diameter and an outer diameter of the front end portion of the container main body 20, to which the front fitting 21 is assembled, are formed to be respectively smaller than an inner diameter and an outer diameter of the rear end portion of the container main body 20. A plurality of annular grooves 22 recessed toward a radial direction inner side are formed in an outer peripheral surface of the front end portion of the container main body 20 in order to be fitted to an inner peripheral surface of the front fitting 21, to be described in detail below. A plurality of grooves (not illustrated) that can be fitted to a knurled outer peripheral surface 562 (see FIG. 15) formed on a top crown (a barrel rear end tube) 56 of the plunger 50, to be described in detail below, are formed in an inner peripheral surface of the rear end portion of the container main body 20. The container main body 20 is formed from a resin material that can be molded easily.

"Valve 30"

The valve 30 includes the discharge pipe support portion 31 for supporting a rear end portion of the discharge pipe 10, the valve main body 32, which is configured such that a rear portion of the discharge pipe support portion 31 is assembled to a front portion thereof, a valve body 33 disposed in the valve main body 32, and a spring 34 constituted by a coil spring that can be compressed in the axial direction so as to bias the valve body 33 rearward.

Figure 2:
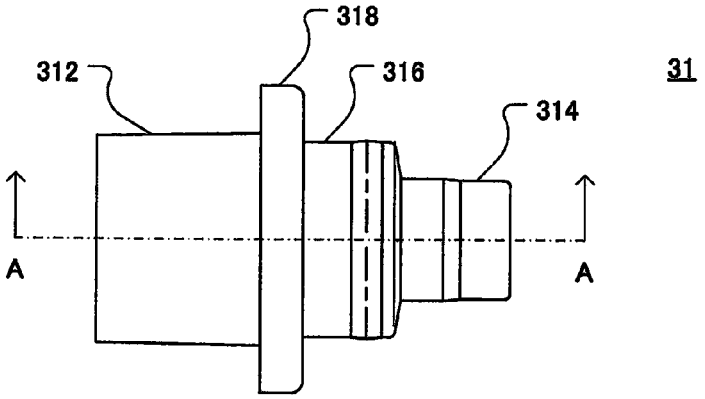
FIG. 2 is a side view illustrating, from the side, a discharge pipe support portion included in a valve of the dispenser according to the embodiment.
Figure 3:
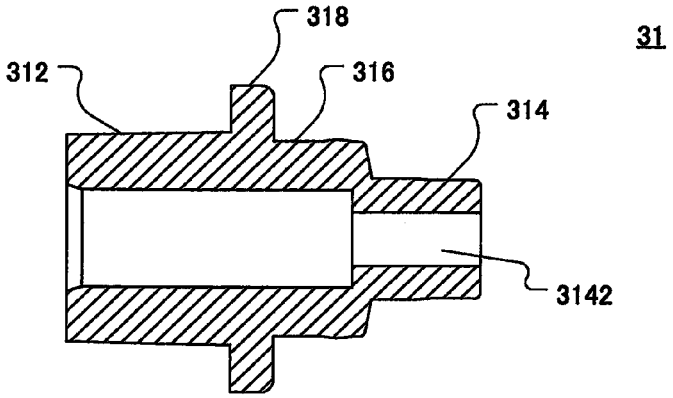
FIG. 3 is a sectional view illustrating the discharge pipe support portion from the direction of an arrow A-A in FIG. 2, taken along an A-A line in FIG. 2.

As illustrated in FIGS. 2 and 3, the discharge pipe support portion 31 includes a front portion 312 and a rear portion 314 that are both substantially tubular but have different radial direction dimensions to each other, an inner diameter and an outer diameter of the front portion 312 being formed to be respectively larger than an inner diameter and an outer diameter of the rear portion 314. A central portion 316 is formed between the front portion 312 and the rear portion 314. An outer diameter of the central portion 316 is formed to be smaller than the outer diameter of the front portion 312 but larger than the outer diameter of the rear portion 314, while an inner diameter of the central portion 316 is formed to be identical to the inner diameter of the front portion 312 but larger than the inner diameter of the rear portion 314. An annular projection 318 that projects radially outward such that an outer peripheral surface thereof can be fitted to an inner peripheral surface of a front portion 322 of the valve main body 32 is formed between the front portion 312 and the central portion 316. The rear portion 314 of the discharge pipe support portion 31 is formed such that a front part and a rear part thereof have different radial direction dimensions, and an outer peripheral surface of the front part thereof is formed to have a larger outer diameter than the rear part so as to be fitted to an inner peripheral surface of a front end portion of the spring 34, to be described in detail below. An annular projection that projects radially outward so as to be fitted to an inner peripheral surface of a central portion of the valve main body 32, to be described in detail below, is formed on an outer peripheral surface of a rear part of the central portion 316. The rear end portion of the discharge pipe 10 is press-fitted into a hollow portion in the front portion 312 and the central portion 316 of the discharge pipe support portion 31. A hollow portion in the rear portion 314 of the discharge pipe support portion 31 communicates with the discharge flow passage 12 of the press-fitted discharge pipe 10 so as to form a delivery flow passage 3142 for delivering the fluid F to the discharge flow passage 12. The discharge pipe support portion 31 is formed from a resin material that can be molded easily.

Figure 4:
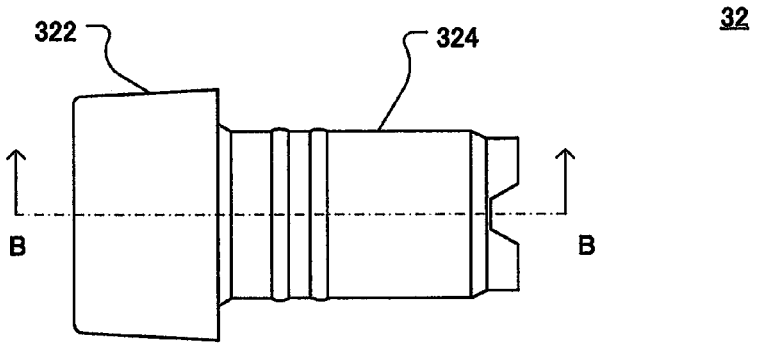
FIG. 4 is a side view illustrating, from the side, a valve main body included in the valve of the dispenser according to the embodiment.
Figure 5:
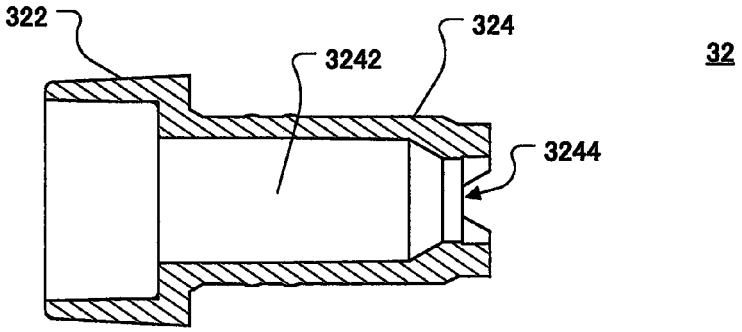
FIG. 5 is a sectional view illustrating the valve main body from the direction of an arrow B-B in FIG. 4, taken along a B-B line in FIG. 4.
Figure 6:
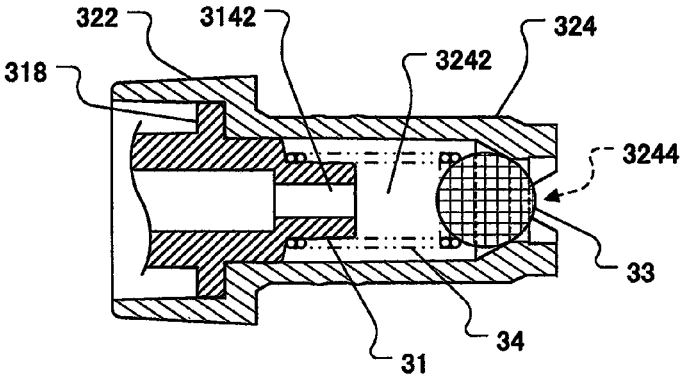
FIG. 6 is a sectional view illustrating a condition in which the discharge pipe support portion, a spring, and a valve body are assembled to the valve main body, according to the embodiment.

As illustrated in FIGS. 4 to 6, the valve main body 32 includes the front portion 322, which is substantially tubular, and a central portion and a rear portion 324, which are both substantially tubular but have a smaller diameter than the front portion 322. An outer peripheral surface of the central portion of the valve main body 32, which includes a plurality of annular projections projecting radially outward, is fitted to an inner peripheral surface of the front end portion of the container main body 20. An inner peripheral surface of the front portion 322 of the valve main body 32 is fitted to the outer peripheral surface of the annular projection 318 of the discharge pipe support portion 31, and an inner peripheral surface of the central portion of the valve main body 32 is fitted to an outer peripheral surface of the central portion 316 of the discharge pipe support portion 31. A rear side plane (an orthogonal plane to the axial direction) of the annular projection 318 of the discharge pipe support portion 31 abuts a step portion formed on the inner peripheral surface of the valve main body 32, thereby preventing the discharge pipe support portion 31 from moving rearward relative to the valve main body 32.

When the valve main body 32 is fitted to the front end portion of the container main body 20, a hollow portion in the rear portion 324 of the valve main body 32 connects the tank T to the delivery flow passage 3142 of the discharge pipe support portion 31 so as to form a delivery flow passage 3242 for delivering the fluid F from the tank T to the delivery flow passage 3142 of the discharge pipe support portion 31. A rear end side of the delivery flow passage 3242 of the valve main body 32 is formed to be smaller in the radial direction than a front end side, whereby an inclined inner peripheral surface that inclines relative to the axial direction such that an inner diameter thereof decreases steadily rearward is formed as a valve seat surface of the valve main body 32. A rear end opening 3244 serving as a valve hole is formed to the rear of the valve seat surface. The valve body 33, which is biased rearward by the spring 34, to be described in detail below, abuts the valve seat surface of the valve main body 32.

The valve body 33 is formed in a spherical shape having a larger diameter than an inner diameter of the rear end opening 3244 of the valve main body 32, and can therefore close the delivery flow passage 3242 of the valve main body 32 by abutting the valve seat surface of the valve main body 32.

The spring 34 is formed as a compression coil spring, and configured such that an inner peripheral surface of a front end portion thereof is fitted to the outer peripheral surface of the front part of the rear portion 314 of the discharge pipe support portion 31, and a rear end portion thereof abuts the valve body 33. The spring 34 continuously biases the valve body 33 such that the valve body 33 is pressed onto the rearward valve seat surface, and in a set condition where the spring 34 is compressed by a predetermined amount, the spring 34 is disposed between the rear portion 314 of the discharge pipe support portion 31 and the valve body 33. As will be described in detail below, except when the fluid F in the tank T is pushed out frontward by the plunger 50, the valve body 33 is pressed onto the rearward valve seat surface by the spring 34 so as to close the delivery flow passage 3242, thereby preventing the fluid F in the tank T from leaking into the delivery flow passage 3242. The valve body 33 and the spring 34 are preferably formed from a highly anti-corrosive material, and in this embodiment are formed from stainless steel.

The spring 34 is sufficiently elastic to be compressable in the axial direction. When the plunger 50, to be described in detail below, pushes out the fluid F frontward, the valve body 33 is moved forward by a pressing force exerted on the valve body 33 against the biasing force of the spring 34. When the valve body 33 moves forward, the delivery flow passage 3242 and the rear end opening 3244 of the valve 30 are opened such that the fluid F passes through the delivery flow passage 3242 and the delivery flow passage 3142 and is discharged through the discharge flow passage 12 of the discharge pipe 10.

In this embodiment, when the plunger 50, to be described in detail below, pushes out the fluid F frontward, the coils of the compressed spring 34 remain in closed contact with each other by a predetermined solid length such that the spring 34 holds the valve body 33 in a predetermined position in the axial direction. With this configuration, an opening amount of the valve 30 can be set at a predetermined opening amount, and as a result, a discharge amount of the fluid F can be set at a predetermined discharge amount. Further, by ensuring that the coils of the spring 34 remain in closed contact with each other by a predetermined solid length, direct contact between the rear end of the discharge pipe support portion 31 and the front end of the valve body 33 can be prevented even when the valve 30 is operated or an external force is exerted on the dispenser 1 such that the valve body 33 moves forward to a maximum extent. As a result, a situation in which negative pressure is generated in the delivery flow passage 3142 of the discharge pipe support portion 31 while the rear end of the discharge pipe support portion 31 and the front end of the valve body 33 are in direct contact with each other such that the front end of the valve body 33 is adsorbed to the rear end of the discharge pipe support portion 31 can be prevented from occurring. Meanwhile, when the coils of the spring 34 are in closed contact with each other, a large number of contact points are formed between the spring coils of the spring 34, and therefore, when negative pressure is generated in the delivery flow passage 3142 of the discharge pipe support portion 31 while the coils of the spring 34 are in closed contact with each other, the closed contact between the coils of the spring 34 can be released easily in order to break the negative pressure in the delivery flow passage 3142 of the discharge pipe support portion 31.

"Front Fitting 21"

Figure 7:
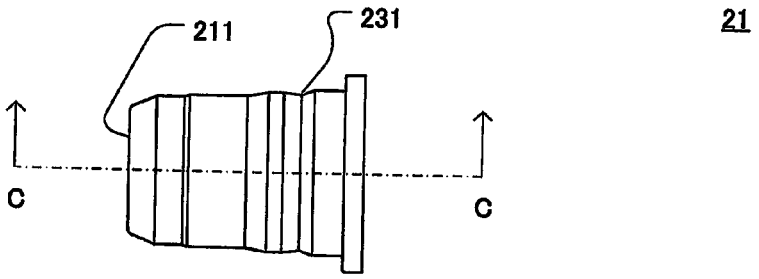
FIG. 7 is a side view illustrating, from the side, a front fitting of the dispenser according to the embodiment.
Figure 8:
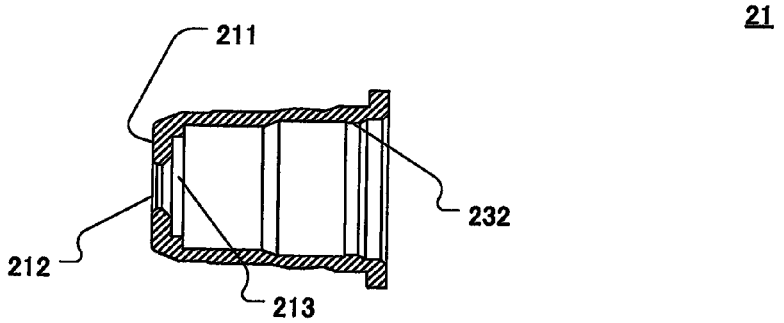
FIG. 8 is a sectional view illustrating the front fitting from the direction of an arrow C-C in FIG. 7, taken along a C-C line in FIG. 7.
Figure 9:
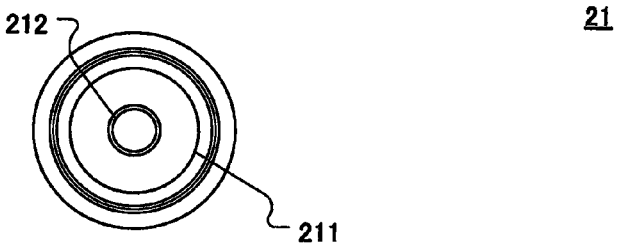
FIG. 9 is a view illustrating the front fitting from a direction of a through hole formed in a front end portion thereof.
Figure 10:
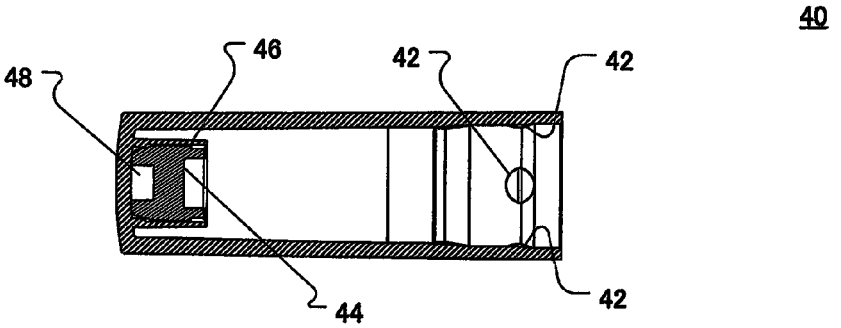
FIG. 10 is a sectional view illustrating a cap of the dispenser according to the embodiment, taken along a cross-section that includes a central axis thereof.
Figure 11:
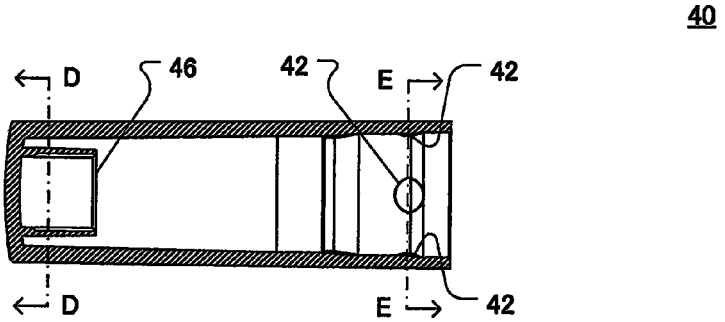
FIG. 11 is a sectional view illustrating the cap in a condition where seal packing has been removed.
Figure 12:
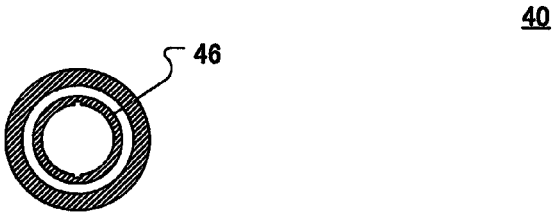
FIG. 12 is a sectional view illustrating the cap from the direction of an arrow D-D in FIG. 11, taken along a D-D line in FIG. 11.
Figure 13:
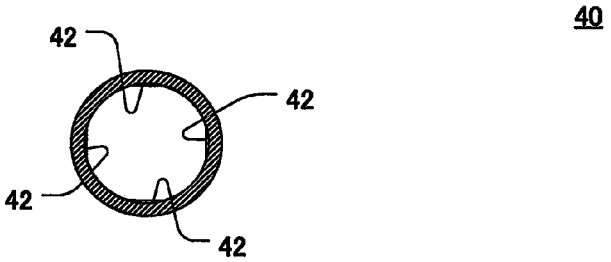
FIG. 13 is a sectional view illustrating the cap from the direction of an arrow E-E in FIG. 11, taken along an E-E line in FIG. 11.

As illustrated in FIGS. 7 to 9, the front fitting 21 is configured such that a heat reflection surface 211, to be described in detail below, is provided on a front end surface thereof so as to cover the front end portion of the dispenser 1, and a rear end thereof is formed in an open hollow shape. An annular groove 231 that is fitted to a latch projection 42 formed on an inner peripheral surface of the cap 40 is formed in a rear portion outer peripheral surface of the front fitting 21, and an annular projection 232 that is fitted to the annular groove 22 formed in the outer peripheral surface of the front end portion of the container main body 20 is formed on a rear portion inner peripheral surface of the front fitting 21. In this embodiment, the front fitting 21, which is used opposite a heat source, is formed from a material such as a metal material, for example, exhibiting greater heat resistance than the container main body 20, the discharge pipe support portion 31, and the valve main body 32, which are formed from a resin material, and in this embodiment, the front fitting 21 is formed from brass.

The heat reflection surface 211 is formed on the front end of the front fitting 21 in a circular shape so as to extend in an orthogonal direction to the axial direction. A through hole 212 through which the discharge pipe 10 passes is formed in the center of the heat reflection surface 211. A diameter of the through hole 212 is formed to be larger than the outer diameter of the discharge pipe 10 so that the discharge pipe 10 does not contact the front fitting 21. With this configuration, it is possible to prevent the front end portion of the dispenser 1, which in this embodiment is used opposite a heat source, from being heated by radiant heat from the heat source, and therefore thermal conduction from the front fitting 21 to the discharge pipe 10 can be prevented. As a result, leakage of the fluid F from the discharge pipe 10 and breakage of the front end portion of the dispenser 1 due to heating of the front end portion of the dispenser 1, which includes the valve 30 and so on that are comparatively easily heated and jammed, can be prevented. Leakage of the fluid F due to heating of the front end portion of the dispenser 1 occurs in situations where, for example, the valve 30 is heated such that thermal expansion occurs in the constituent components thereof, which are formed from different materials, at respectively different thermal expansion coefficients. In this case, the valve 30 may not be able to keep the delivery flow passage 3242 closed, and as a result, a function of the dispenser 1 for preventing leakage of the fluid F may be lost. A surface area of the heat reflection surface 211 is preferably set to be larger than a surface area of an outer circumference of a cross-section of the discharge pipe 10 orthogonal to the axial direction, for example. The surface area of the heat reflection surface 211 is more preferably at least twice the surface area of the outer circumference, and most preferably at least three times the surface area of the outer circumference.

When the discharge pipe 10 is caused to project frontward from the heat reflection surface 211 by a sufficient length, as in this embodiment, heat conduction through the discharge pipe 10 to the valve 30 can be suppressed. Moreover, in this embodiment, the front surface of the heat reflection surface 211 is finished as a mirror surface in order to improve the heat reflectivity of the heat reflection surface 211. With this configuration, heating of the front end portion of the dispenser 1 can be suppressed more effectively. Furthermore, in this embodiment, as illustrated in FIG. 1, a thermal insulation space 213 extending in the axial direction is defined between the discharge pipe support portion 31 and the front fitting 21 to the rear of the heat reflection surface 211 of the front fitting 21. With this configuration, heat conduction from the front fitting 21 to the front end portion of the dispenser 1, including the valve 30, can be suppressed by the thermal insulation space 213.

"Cap 40"

As illustrated in FIGS. 10 to 13, the cap 40 is formed in a substantially tubular shape with a closed front end portion so as to be capable of covering the discharge pipe 10 when fitted to the front fitting 21. The latch projection 42 is formed at 90-degree circumferential direction intervals so as to project radially inward on an inner peripheral surface of a rear end portion of the cap 40. By fitting the projections 42 formed on the cap 40 into the aforementioned annular groove 231 in the front fitting 21, the cap 40 can be attached detachably to the front fitting 21.

A tubular housing tube 46 projecting rearward in the axial direction is formed on an inner side of a front end closing wall of the cap 40. A pair of cutouts extending in the axial direction are formed in an inner peripheral surface of the housing tube 46 (see FIG. 12), and substantially cylindrical seal packing 44 having a pair of ribs that extend in the axial direction so as to fit into the cutouts on an outer peripheral surface thereof is incorporated into the housing tube 46. By fitting the ribs of the seal packing 44 to the cutouts in the housing tube 46 of the cap 40, the seal packing 44 is incorporated securely so as to be prevented from rotating relative to the cap 40. Circular counterbores (spot facings) having a larger opening area than the outer diameter of the discharge pipe 10 are formed respectively in a front end surface and a rear end surface of the seal packing 44. When the cap 40 is fitted to the front fitting 21, the seal packing 44 contacts a front end portion of the discharge pipe 10 so as to cover the front end portion, thereby closing the discharge port 122 of the discharge pipe 10. The seal packing 44 is formed from an elastic material so that when the seal packing 44 comes into contact with the discharge pipe 10, the seal packing 44 is pressed and thereby elastically deformed. Accordingly, the seal packing 44 closes the discharge port 122 in a condition where a part of the contact portion thereof projects into the discharge port 122 of the discharge pipe 10 (see FIG. 1).

By configuring the seal packing 44 such that the portion of the seal packing 44 that contacts the discharge pipe 10 partially projects into the discharge port 122, positive pressure can be generated in the fluid F delivered into the discharge flow passage 12, the delivery flow passage 3142, and the delivery flow passage 3242, and as a result, the valve body 33 can be pressed onto the valve seat surface. Therefore, when an external force is exerted on the dispenser 1 while the dispenser 1 is transported, the valve body 33 can be prevented from being moved forward by the external force such that the delivery flow passage 3242 and the rear end opening 3244 are no longer closed by the valve 30. In this embodiment, a space 48 is defined between a rear surface of the front end closing wall of the cap 40 and a front surface of the seal packing 44 by the circular counterbore formed in the front end of the seal packing 44. With this configuration, a space can be provided for the seal packing 44 to elastically deform frontward when the seal packing 44 is pressed in the axial direction so as to project into the discharge pipe 10, and as a result, an excessive pressing force can be prevented from being exerted on the discharge pipe 10 pressed by the seal packing 44.

"Plunger 50"

As illustrated in FIG. 1, the plunger 50 includes the clicking body 51, which is formed in a substantially tubular shape and has a closed rear end, a piston (a piston cup) 52 configured to be capable of moving forward by sliding along an inner wall of the tank T, a piston rod 53 having a external screw formed on an outer peripheral surface thereof so as to be capable of pushing the piston 52 forward, a rotation cam 54 screwed to the piston rod 53, a swing cam 55 that is assembled to the clicking body 51 so as to swing relative to the rotation cam 54 in order to rotate the rotation cam 54 in a single rotational direction, the top crown 56, to which the clicking body 51 is assembled to be capable of executing a clicking operation, and which supports the piston rod 53 to be capable of moving forward but incapable of rotating in the circumferential direction, and a return spring 57 that biases the swing cam 55 and the clicking body 51 away from each other. When the clicking body 51 executes a clicking operation, the swing cam 55 swings so as to rotate the rotation cam 54 in a single rotational direction, whereby the piston rod 53, to which the rotation cam is screwed, is pressed forward, and as a result, the piston 52 and the piston rod 53 advance.

Figure 14:
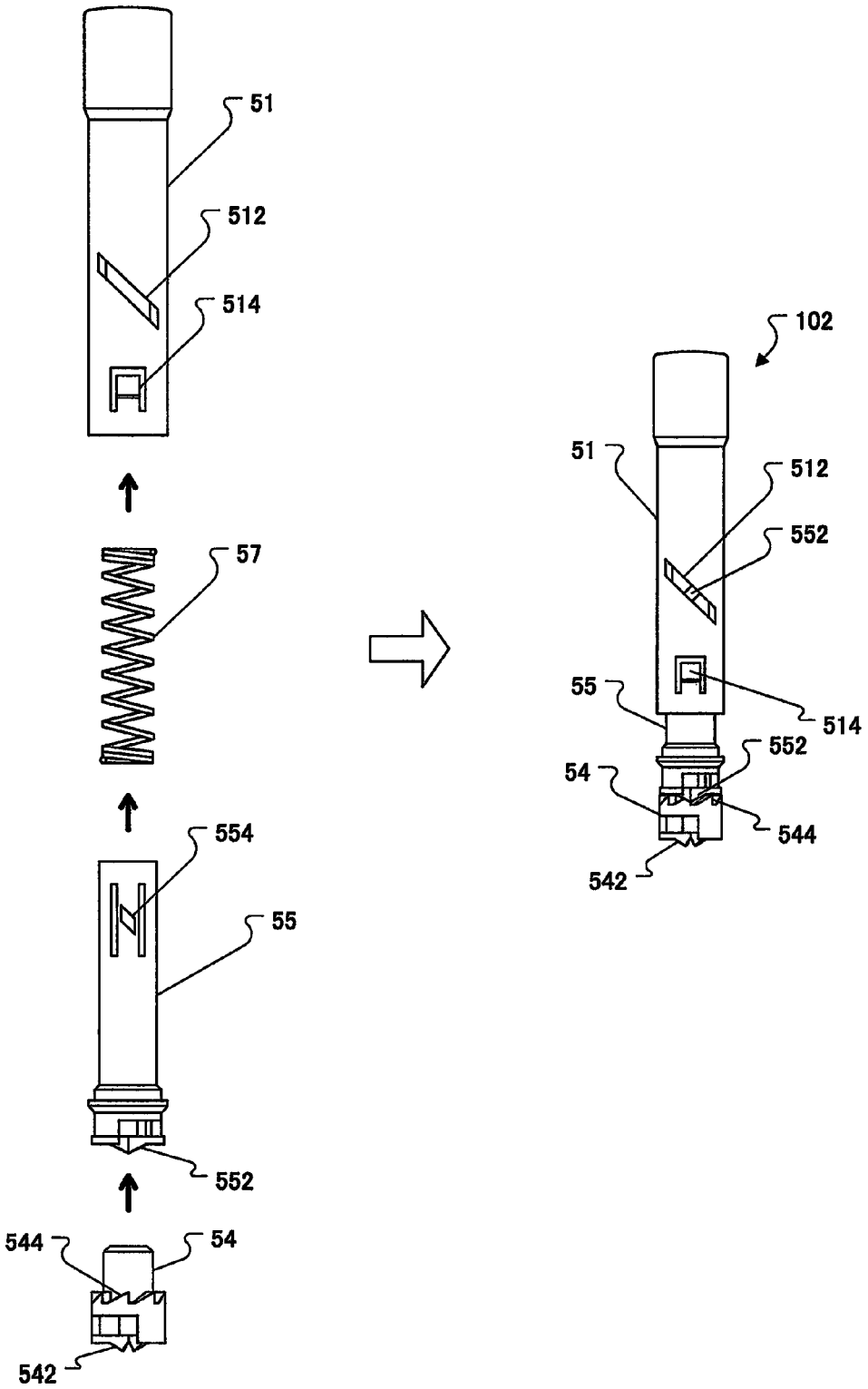
FIG. 14 is a schematic view illustrating procedures for assembling a clicking set of the dispenser according to the embodiment.
Figure 15:
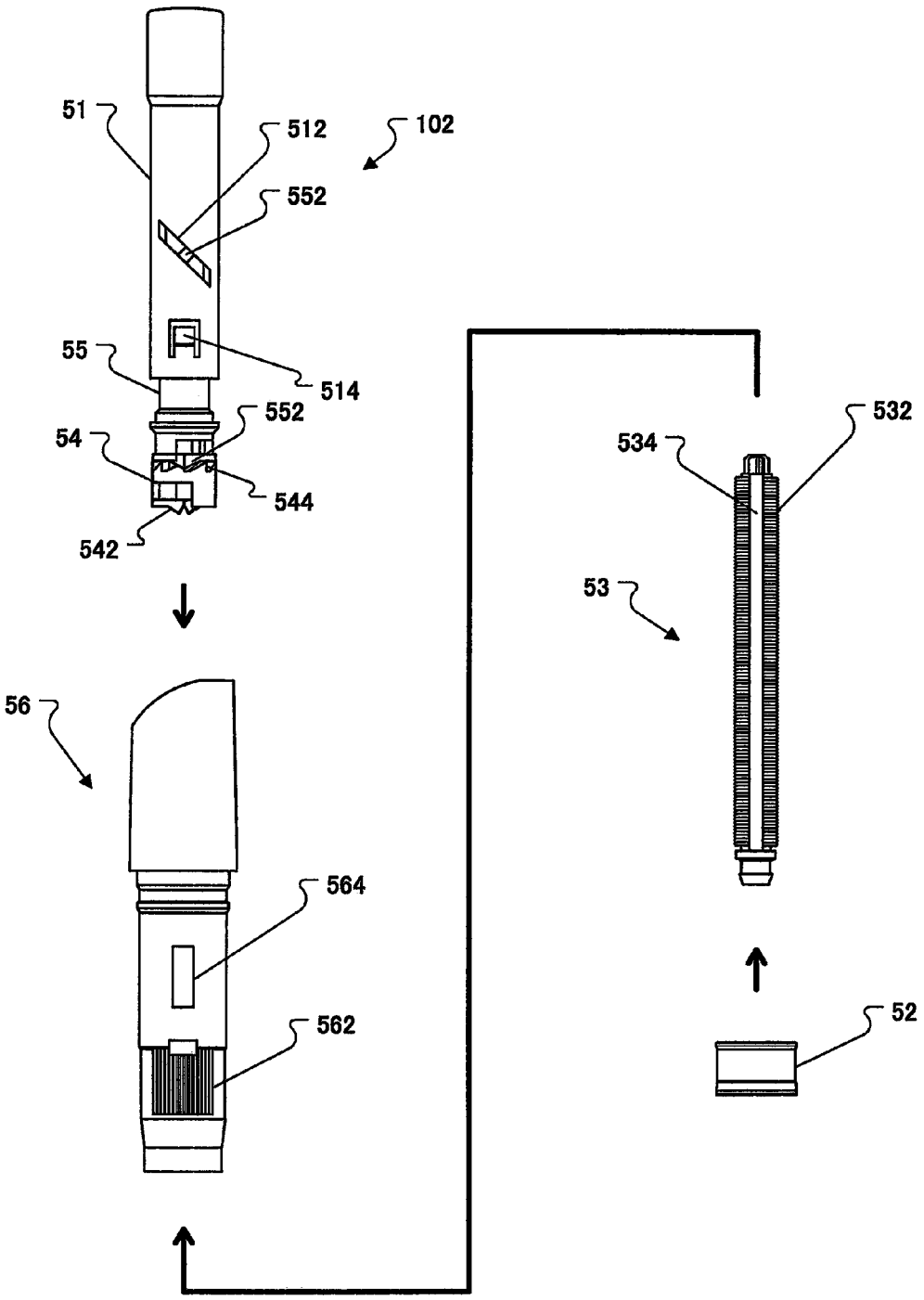
FIG. 15 is a schematic view illustrating procedures for assembling a plunger of the dispenser according to the embodiment.

Referring to FIGS. 14 and 15, the respective constituent elements of the plunger 50, as well as procedures for assembling these elements, will be described in further detail. As illustrated in FIG. 14, a front portion of the rotation cam 54, which is formed in a substantially tubular shape, is formed to be larger in the radial direction than the rear portion, which is likewise formed in a substantially tubular shape. A ratchet teeth 542 that have cam surfaces inclining in the circumferential direction and are elastically supported in the axial direction so as to project frontward are formed on a front end surface of the front portion of the rotation cam 54. A plurality of saw teeth 544 having cam surfaces that incline in the circumferential direction are formed on a rear end surface facing the rear of the front portion of the rotation cam 54. The swing cam 55 is formed in a substantially tubular shape. By fitting, and thereby assembling, an outer peripheral surface of the rear portion of the rotation cam 54 slidably to an inner peripheral surface of a front portion of the swing cam 55, the rotation cam 54 can rotate in the circumferential direction relative to the swing cam 55. A ratchet teeth 552 that have cam surfaces inclining in the circumferential direction and are elastically supported in the axial direction so as to project frontward are formed on a front end portion of the swing cam 55. The ratchet teeth 552 of the swing cam 55 engage with the saw teeth 544 formed on the rear end surface of the front portion of the rotation cam 54 so as to drive the rotation cam 54 to rotate in only one rotational direction.

A projection 554 that projects radially outward is formed on an outer peripheral surface of a rear portion of the swing cam 55 so as to be capable of elastic deformation in the radial direction. When the swing cam 55 is assembled to the clicking body 51, the projection 554 on the swing cam 55 is inserted slidably into an inclined hole 512 that is formed in the clicking body 51 to extend diagonally relative to the axial direction. By sliding the swing cam 55 within the inclined hole 512 in the clicking body 51 as the clicking body 51 executes a clicking operation, the swing cam 55 is driven to rotate in the circumferential direction. The swing cam 55 is assembled to the clicking body 51 such that the return spring 57, which is formed from a compression coil spring provided between the swing cam 55 and the clicking body 51, is compressed in the axial direction. A projection 514 that projects radially outward is formed on an outer peripheral surface of a front portion of the clicking body 51 to be capable of elastic deformation in the radial direction. When the clicking body 51 is assembled to the top crown 56, the projection 514 on the clicking body 51 is inserted into a vertical hole 564 formed in the top crown 56, to be described in detail below, with the result that the clicking body 51 is latched to the top crown 56 so as to be capable of moving in the axial direction relative thereto. The clicking body 51, the rotation cam 54, the swing cam 55, and the return spring 57 together constitute a clicking set 102 serving as a rotation cam driving mechanism.

The clicking set 102 is assembled to the top crown 56, and the top crown 56 is assembled to the container main body 20. An outer peripheral surface of the substantially tubular top crown 56 is formed with the knurled outer peripheral surface 562 (see FIG. 15) that is fitted to the plurality of axially extending grooves formed in the inner peripheral surface of the container main body 20, as described above, so as to prevent the top crown 56 from rotating relative to the container main body 20. The vertical hole 564 is formed in a central portion of the top crown 56 so as to extend in the axial direction. When the clicking set 102 is incorporated into the top crown 56 from the rear, as illustrated in the figures, the projection 514 on the clicking body 51 is fitted into the vertical hole 564 in the top crown 56 such that the clicking body 51 is restricted to movement in the axial direction alone. A plurality of saw teeth (not illustrated) having cam surfaces that incline in the circumferential direction are formed on an inner peripheral surface of a front end portion of the top crown 56. The saw teeth formed on the inner peripheral surface of the front end portion of the top crown 56 engage with the ratchet teeth 542 of the rotation cam 54 such that the rotation cam 54 is allowed to rotate in only one rotational direction and prevented from rotating in the other rotational direction.

A pair of contact surfaces 534 extending in the axial direction are formed at 180-degree intervals in the circumferential direction on an outer peripheral surface of the piston rod 53. FIG. 15 illustrates only one of the pair of contact surfaces 534. An opening through which the piston rod 53 passes is formed in the front end portion of the top crown 56. A pair of contact surfaces (not illustrated) are formed on an inner peripheral surface of the opening in the top crown 56 so as to oppose the pair of contact surfaces 534 formed on the piston rod 53. When the contact surfaces 534 of the piston rod 53 contact the contact surfaces of the top crown 56, the piston rod 53 is supported on the top crown 56 to be capable of moving forward but incapable of relative rotation in the circumferential direction. The piston 52 is assembled to the front end portion of the piston rod 53.

"Assembly"

Figure 16:
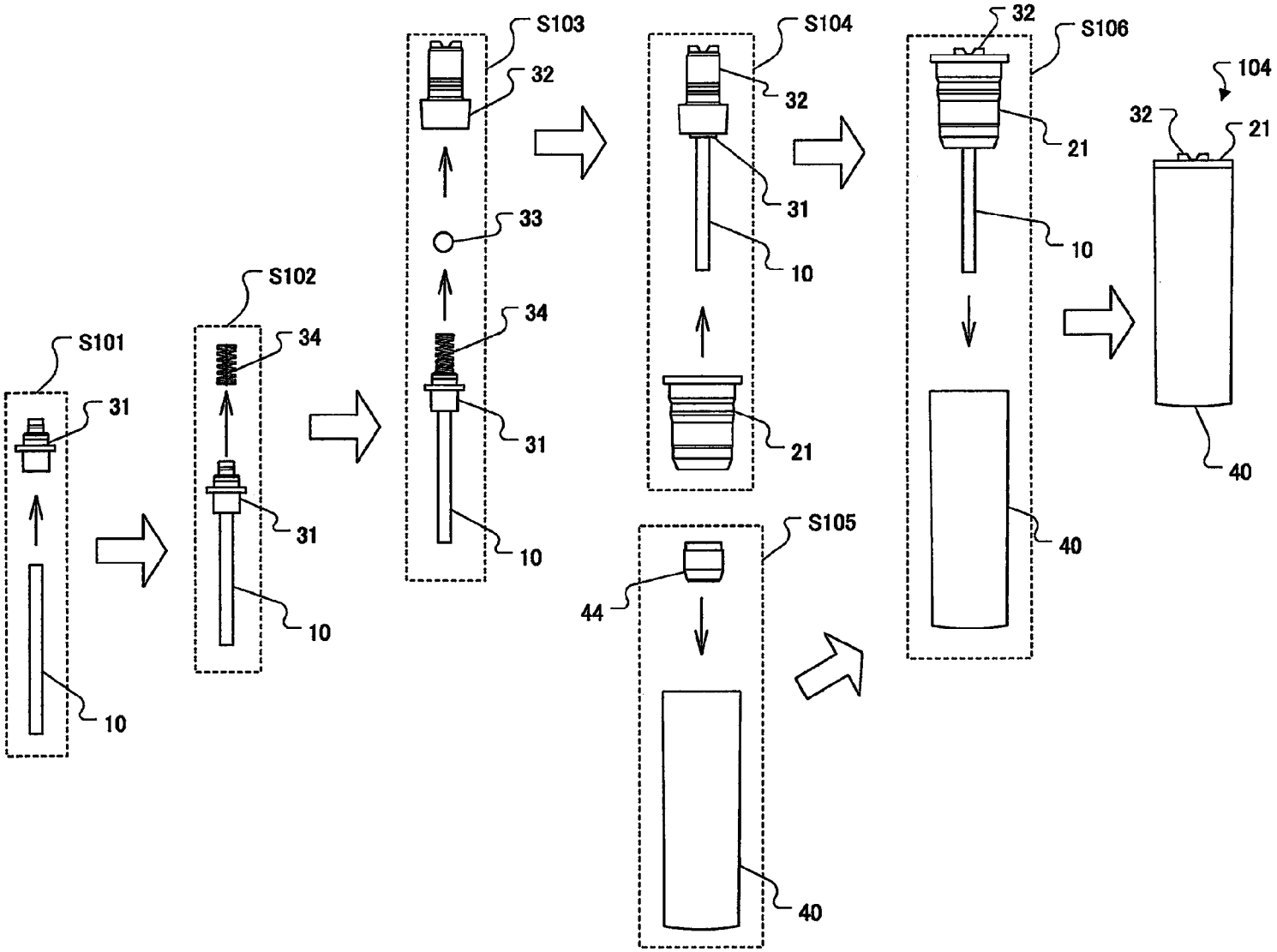
FIG. 16 is a schematic view illustrating procedures for assembling a cap set including the front fitting, the valve, the discharge pipe, and the cap of the dispenser according to the embodiment.

Assembling of the dispenser 1 will now be described. As illustrated in FIG. 16, the rear end portion of the discharge pipe 10 is press-fitted into the discharge pipe support portion 31 (S101), and the front end portion of the spring 34 is assembled to the rear portion 314 of the discharge pipe support portion 31 (S102). Next, the rear end portion of the discharge pipe support portion 31 is fitted, and thereby assembled, to the front portion of the valve main body 32 such that the valve body 33 is pressed onto the valve seat surface of the valve main body 32 by the biasing force of the spring 34 (S103). Next, the discharge pipe support portion 31 is assembled into the front fitting 21 such that the discharge pipe 10 projects from the through hole 212 of the front fitting 21 (S104). Further, the seal packing 44 is assembled into the cap 40 (S105). Next, the cap 40 is assembled to the front fitting 21 (S106), whereby a cap set 104 including the discharge pipe 10, the valve 30, and the cap 40 can be assembled.

Figure 17:
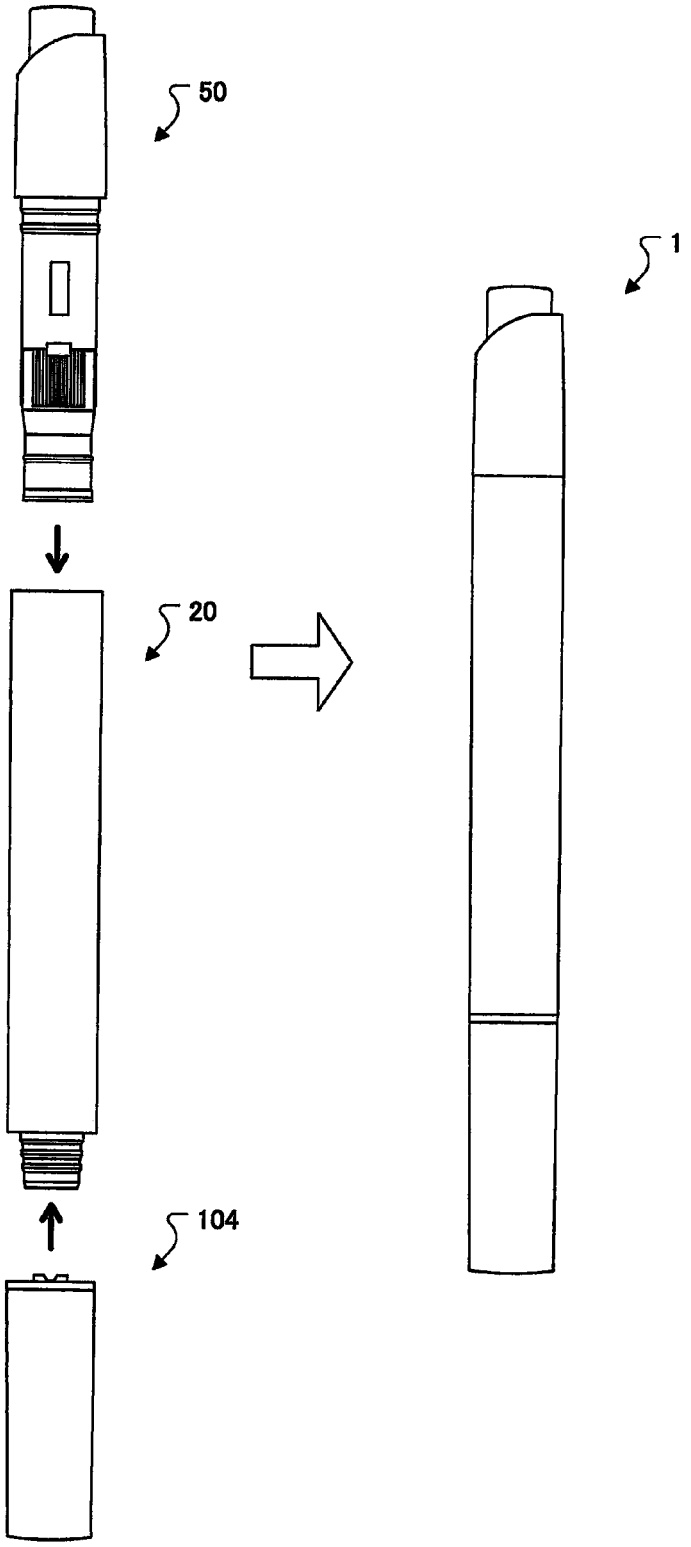
FIG. 17 is a schematic view illustrating procedures for assembling the dispenser according to the embodiment.

As illustrated in FIG. 17, by fitting the annular projection 232 on the front fitting 21 of the cap set 104 to the annular groove 22 of the container main body 20, the rear portion 324 of the valve main body 32 is fitted into the front end portion of the container main body 20, whereby the cap set 104 is assembled to the container main body 20. Next, the plunger 50 is assembled to the container main body 20 by press-fitting the plunger 50 from the rear of the container main body 20, whereby the dispenser 1 is completed. In another embodiment, another desired attachment structure such as a screw may be employed instead of fitting and press-fitting a projection and a groove, as in this embodiment.

"Operation"

An operation of the above dispenser 1 will now be described. When a user removes the cap 40 from the front fitting 21, brings the discharge pipe 10 close to a subject to be discharged, and clicks the clicking body 51 down against the biasing force of the return spring 57, the clicking body 51 advances relative to the swing cam 55. When the inclined hole 512 in the clicking body 51 advances relative to the projection 554 on the swing cam 55, the swing cam 55 and the rotation cam 54 engaged to the swing cam 55 rotate in a single direction in the circumferential direction. When the rotation cam 54 rotates, the piston rod 53 screwed to the rotation cam 54 advances, thereby pushing out the fluid F frontward. The rear end surface of the top crown 56 is formed at an incline relative to the axial direction so as to prevent unintentional advancement (a malfunction) of the clicking body 51, and therefore the piston 52 advances so as to push out the fluid F frontward only when the user intentionally executes a clicking operation.

When the fluid F is pushed out frontward by the plunger 50, a pressing force generated by the fluid F is exerted on the valve body 33 that closes the delivery flow passage 3242 and the rear end opening 3244 of the valve main body 32 communicating with the tank T. When the spring 34 that elastically supports the valve body 33 elastically deforms such that the valve body 33 moves forward, the delivery flow passage 3242 and the rear end opening 3244 of the valve main body 32 are opened. The plunger 50 is capable of pushing out the fluid F frontward in a predetermined amount corresponding to the clicking operation, and therefore the fluid F is delivered in a predetermined amount to the delivery flow passage 3242 of the valve main body 32 through the rear end opening 3244 of the valve main body 32. The fluid F delivered in a predetermined amount to the delivery flow passage 3242 of the valve main body 32 is delivered to the discharge flow passage 12 of the discharge pipe 10 through the delivery flow passage 3142 of the discharge pipe support portion 31, and then discharged through the discharge port 122 of the discharge pipe 10.

When the piston 52 stops such that the pressing force exerted on the valve body 33 is released, the spring 34 presses the valve body 33 rearward so as to close the delivery flow passage 3242 and the rear end opening 3244 of the valve main body 32 again. By closing the delivery flow passage 3242 and the rear end opening 3244 of the valve main body 32 in this manner, the fluid F can be prevented from flowing out of the tank T unintentionally.

When the clicking body 51 advances such that the rotation cam 54 rotates in a single rotational direction, the ratchet teeth 542 of the rotation cam 54 travel over cam ridges of the saw teeth formed on the inner peripheral surface of the front end portion of the top crown 56 while retreating, thereby rotating in a single direction. At this time, a clicking sound is generated when the ratchet teeth 542 of the rotation cam 54 contact the cam ridges of the top crown 56, allowing the user to ascertain the operation amount.

When the downward pressure applied to the clicking body 51 is released, the clicking body 51 is caused to retreat by the elastic force of the return spring 57, and as a result, the swing cam 55 rotates in the other rotational direction (an opposite rotational direction). At this time, the ratchet teeth 542 of the rotation cam 54 cannot climb over the saw teeth of the top crown 56, and therefore the rotation cam 54 does not rotate in the other rotational direction. Hence, only the swing cam 55 rotates in the other rotational direction. The ratchet teeth 552 of the swing cam 55 travel over the cam ridges of the saw teeth 544 of the rotation cam 54 while retreating, thereby rotating in the other rotational direction. At this time, a clicking sound is generated when the ratchet teeth 552 of the swing cam 55 contact the saw teeth 544 of the rotation cam 54, allowing the user to be aware of the operation of the plunger 50.

When the clicking body 51 retreats, the dispenser 1 is returned to a condition of being capable of performing a clicking operation. Once the fluid F has been discharged in a predetermined amount by repeating the series of operations described above as appropriate, the discharge port 122 of the discharge pipe 10 can be closed by the seal packing 44 of the cap 40 by attaching the cap 40 to the front fitting 21. As a result, leakage of the fluid F from the discharge port 122 can be prevented doubly, i.e. by both the valve 30 and the cap 40. Furthermore, in this embodiment, as illustrated in FIG. 1, the discharge port 122 is closed by having a part of the seal packing 44 project into the interior of the discharge pipe 10. Hence, positive pressure can be applied to the fluid F existing in the discharge flow passage 12 of the discharge pipe 10, the delivery flow passage 3142 of the discharge pipe support portion 31, and the delivery flow passage 3242 of the valve main body 32 such that the valve body 33 can be pressed onto the rearward valve seat surface, and as a result, leakage of the fluid F can be prevented even more reliably.

Moreover, in a case where the fluid F is an aromatic substance (a perfumed oil) that is volatilized when discharged onto a heating plate, as in this embodiment, by providing the front fitting 21 having the heat reflection surface 211 that extends in an orthogonal direction to the axial direction, the front end portion of the dispenser 1 can be protected from being heated by heat radiation from a heat source such as a heating plate of an aroma pot even when the front end portion of the dispenser 1 is brought close to the heat source in order to discharge the fluid F. Furthermore, by configuring the front fitting 21 and the discharge pipe 10 not to contact each other, heat is not conducted from the front fitting 21 to the discharge pipe 10.

It is preferred for the heat reflection surface to be capable of reflecting heat so as to prevent the front end portion of the dispenser from being heated, as in this embodiment, and although the heat reflection surface 211 according to this embodiment, which extends in an orthogonal direction to the axial direction, is most preferable, in another embodiment, the heat reflection surface may extend in a direction having an incline angle of no more than 30 degrees relative to an orthogonal direction to the axial direction, and in a further embodiment, the heat reflection surface may extend in a direction having an incline angle of no more than 45 degrees relative to an orthogonal direction to the axial direction.

In the embodiment described above, the dispenser 1 includes the plunger 50 that pushes out the fluid F when the clicking body 51 serving as an operating body is clicked down, but the present invention is not limited thereto, and in another embodiment, another desired plunger that is capable of pushing out the fluid F may be used.

Further, in the embodiment described above, the heat reflection surface 211 is finished as a mirror surface in order to improve the heat reflectivity thereof, but the present invention is not limited thereto, and in another embodiment, a heat reflection surface having a desired roughness for reflecting radiated heat may be provided on the front fitting of the dispenser.

Furthermore, in the embodiment described above, the seal packing 44 elastically deforms so as to project into the discharge port 122 of the discharge pipe 10, but in another embodiment, the seal packing may further include a projecting portion that projects to the rear of the seal packing and can be inserted into the discharge port of the discharge pipe when no external force is exerted thereon, and positive pressure may be exerted on the fluid remaining in the discharge flow passage by this projecting portion. In this case, positive pressure can be exerted on the fluid remaining in the discharge flow passage more favorably.

Moreover, in the embodiment described above, the valve body 33 is biased by the spring 34 formed in a coil shape, but the present invention is not limited thereto, and in another embodiment, the valve body may be biased toward the valve seat surface by another desired elastic body such as a plate spring or a spring having another desired shape.

The present invention may be implemented in various other forms without departing from the spirit or the main features thereof. Therefore, the above embodiment is in all respects merely an example, and is not to be interpreted as limiting the present invention. The scope of the present invention is defined by the claims, and not restricted by the body of the specification. Moreover, all modification and various amendments, substitutions, and improvements within a scope that is equivalent to the claims are assumed to be within the scope of the present invention.

REFERENCE SIGNS LIST

1 Dispenser (fluid container)
10 Discharge pipe (fluid discharge body)
122 Discharge port
20 Container main body
21 Front fitting
211 Heat reflection surface (mirror surface)
212 Through hole
213 Thermal insulation space
30 Valve
31 Discharge pipe support portion
3142 Delivery flow passage (connecting flow passage)
32 Valve main body
3242 Delivery flow passage (connecting flow passage)
3244 Rear end opening
33 Valve body
34 Spring (elastic body)
40 Cap
44 Seal packing (contact body)
50 Plunger
F Fluid
T Tank

What is claimed is:

1. A fluid container including:

a container main body that has a tank housing a fluid;

a fluid discharge body that is disposed on a front end portion of the container main body and discharges the fluid through a discharge port formed in a front end portion thereof;

a plunger that includes an operating body and pushes out the fluid in the tank to the fluid discharge body in a predetermined amount corresponding to an operation of the operating body;

an open/close valve that closes a connecting flow passage connecting the tank to the fluid discharge body when the plunger does not push out the fluid and opens the connecting flow passage when the plunger pushes out the fluid, the open/close valve including a valve seat surface, a valve body that is disposed downstream of the valve seat surface so as to abut the valve seat surface from downstream, and a spring that biases the valve body toward the valve seat surface;

a cap that is attached detachably to the container main body or the fluid discharge body and when attached, closes the discharge port, wherein the cap includes a contact body that contacts the front end portion of the fluid discharge body when the cap is attached, and a part of the contact body projects into the discharge port of the fluid discharge body when the cap is attached.

2. The fluid container according to claim 1, further including a front fitting that covers the open/close valve and includes a through hole through which the fluid discharge body can pass.

3. The fluid container according to claim 2, wherein a heat reflection surface that extends in a direction having an incline angle of not greater than 45 degrees relative to an orthogonal direction to an axial direction is formed on a front end of the front fitting.

4. The fluid container according to claim 3, wherein a space extending in the axial direction is defined between a rear surface of the heat reflection surface of the front fitting and a front surface of the open/close valve.

5. The fluid container according to claim 2, wherein a gap is formed between an inner peripheral surface of the through hole in the front fitting and an outer peripheral surface of the fluid discharge body.

* * * * *